US008490801B2

(12) United States Patent
Smith et al.

(10) Patent No.: US 8,490,801 B2
(45) Date of Patent: Jul. 23, 2013

(54) GLIDE RACK

(75) Inventors: Christopher J. Smith, Hermitage, TN (US); Daniel Hill, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 12/784,822

(22) Filed: May 21, 2010

(65) Prior Publication Data

US 2011/0132348 A1 Jun. 9, 2011

Related U.S. Application Data

(60) Provisional application No. 61/180,470, filed on May 22, 2009.

(51) Int. Cl.
*A47F 5/08* (2006.01)
*F24C 15/16* (2006.01)

(52) U.S. Cl.
USPC ..... 211/153; 312/410; 126/339

(58) Field of Classification Search
USPC ..... 211/153, 126.15, 90.03, 133.5, 126.9; 126/337 R, 339, 337 A; 312/408, 410, 334.1, 312/334.7, 334.27, 333, 334.46, 334.47
See application file for complete search history.

(56) References Cited

U.S. PATENT DOCUMENTS

| | | | | | |
|---|---|---|---|---|---|
| 1,828,435 | A | * | 10/1931 | Otte | 312/408 |
| 1,896,307 | A | * | 2/1933 | Hatch | 312/408 |
| 2,033,792 | A | * | 3/1936 | Sywert et al. | 211/153 |
| 2,033,860 | A | * | 3/1936 | Otte | 312/408 |
| 2,098,198 | A | * | 11/1937 | Sindelar | 108/143 |
| 2,122,645 | A | * | 7/1938 | Jacobs | 248/394 |
| 2,139,174 | A | * | 12/1938 | Saunders | 248/430 |
| 2,168,544 | A | | 8/1939 | Whitney et al. | |
| 2,428,216 | A | * | 9/1947 | Harbison | 312/408 |
| 2,556,612 | A | * | 6/1951 | Buntin | 312/334.12 |
| 2,671,004 | A | | 3/1954 | Chadwick et al. | |
| 2,919,966 | A | * | 1/1960 | Preston | 312/27 |
| 2,944,864 | A | * | 7/1960 | Krivulka | 312/332.1 |
| 3,222,115 | A | * | 12/1965 | Urbank | 312/333 |
| 3,259,447 | A | * | 7/1966 | Deutsch | 312/334.46 |
| 3,356,328 | A | * | 12/1967 | Sachau | 248/245 |
| 3,885,846 | A | * | 5/1975 | Chuang et al. | 312/306 |
| 4,253,400 | A | * | 3/1981 | Fischer et al. | 105/282.3 |

(Continued)

FOREIGN PATENT DOCUMENTS

| | | | | |
|---|---|---|---|---|
| EP | 1788313 | * | 8/2006 | |
| WO | WO 2010/091366 | * | 8/2010 | 211/153 |

OTHER PUBLICATIONS

Machine translation of EP 1788313.*

*Primary Examiner* — James O Hansen
*Assistant Examiner* — Kimberley S Wright
(74) *Attorney, Agent, or Firm* — Pearne & Gordon LLP

(57) ABSTRACT

A rack for an appliance includes a main section having a support frame, and at least one arm coupled to the support frame. The arm is movable relative to the support frame between a first position and a second position. The rack further includes a release member operatively connected to the at least one arm, actuation of the release member causing the at least one arm to move from the first position to the second position. In one example, the rack includes pair of arms coupled to the support frame. In another example, actuation of the release member causes both of the arms to move to the second position.

15 Claims, 8 Drawing Sheets

U.S. PATENT DOCUMENTS 4,651,713 A * 3/1987 Ondrasik, II ..... 126/339
4,979,909 A * 12/1990 Andrews ..... 439/352
5,308,158 A * 5/1994 Vogelgesang et al. ..... 312/319.3
RE35,925 E * 10/1998 Dohr et al. ..... 105/310
6,012,397 A * 1/2000 Krahl et al. ..... 105/286
6,021,909 A * 2/2000 Tang et al. ..... 211/183
6,148,813 A * 11/2000 Barnes et al. ..... 126/339
6,279,467 B1 * 8/2001 Tiemann ..... 99/426
6,297,962 B1 10/2001 Johnson et al.
6,373,707 B1 * 4/2002 Hutchins ..... 361/725
6,386,659 B1 * 5/2002 Muller et al. ..... 312/334.38
6,615,993 B1 * 9/2003 Rudiger ..... 211/26
6,789,861 B1 * 9/2004 Dobberstein ..... 312/330.1
6,938,617 B2 * 9/2005 Le et al. ..... 126/339
6,974,040 B2 * 12/2005 Jahrling ..... 211/41.8
6,997,527 B2 * 2/2006 Cheng ..... 312/332.1
7,137,512 B2 * 11/2006 Nguyen et al. ..... 211/26
7,216,646 B2 * 5/2007 Le et al. ..... 126/339
7,318,532 B1 * 1/2008 Lee et al. ..... 211/26
7,418,967 B2 * 9/2008 Kim ..... 134/57 D
7,731,805 B2 * 6/2010 Banta et al. ..... 134/56 D
2003/0075517 A1 * 4/2003 Jahrling ..... 211/41.8
2004/0094492 A1 * 5/2004 Greenwald et al. ..... 211/26
2007/0261694 A1 * 11/2007 Le et al. ..... 126/339
2008/0129168 A1 * 6/2008 Banta et al. ..... 312/333
2008/0237166 A1 10/2008 Williams et al.
2010/0018517 A1 * 1/2010 Chen ..... 126/337 R
2010/0117502 A1 * 5/2010 Kang et al. ..... 312/408
2010/0218755 A1 * 9/2010 Stewart et al. ..... 126/339

* cited by examiner

GLIDE RACK

RELATED APPLICATIONS

This application claims the benefit of U.S. Provisional Patent Application No. 61/180,470 filed on May 22, 2009, the entire disclosure of which is hereby incorporated herein by reference.

BACKGROUND OF THE INVENTION

1) Field of the Invention

The present invention relates to racks for appliances, and more particularly, to a glide rack for an oven.

2) Description of Prior Art

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Oven racks are often of wire form construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a rack for an appliance includes a main section having a support frame; at least one arm coupled to the support frame and having an end configured to abut a respective downward facing projection on a wall of the appliance, the arm being movable relative to the support frame between a first position and a second position; and a release member operatively connected to the at least one arm, actuation of the release member causing the at least one arm to move from the first position to the second position, wherein the release member includes a first end portion and a second end portion, the first end portion being coupled to the rack at a first side and the second end portion being coupled to the rack at a second opposing side, and wherein the end of the at least one arm is a straight edge.

In accordance with another aspect of the present invention, a rack for an appliance includes: a main section having a support frame adapted to be supported by guide rails in the appliance; a pair of arms coupled to the support frame and each movable relative to the support frame, each arm being movable towards engagement with stop portions on the guide rails for inhibiting removal of the main section from the appliance cavity; and a release member operatively connected to both of the arms, actuation of the release member causing both of the arms to disengage from respective stop portions, wherein the arms each include convex cam surfaces, and wherein the release member includes a pair of link members having convex-shaped end portions configured to engage the convex cam surfaces.

In accordance with another aspect of the present invention, a rack for an appliance includes: a main section having a support frame adapted to be supported by guide rails in the appliance; an auxiliary section having an auxiliary platform area, the auxiliary section being adapted to be slidably coupled to the main section to move between a retracted position and an extended position; a pair of arms coupled to the support frame and each movable relative to the support frame, each arm being resiliently biased away from the main section and towards engagement with one of the stop portions for inhibiting removal of the main section from the appliance cavity; and a release member pivotally coupled to the main section and operatively coupled to both of the arms, actuation of the release member causing both of the arms to disengage from respective stop portions.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
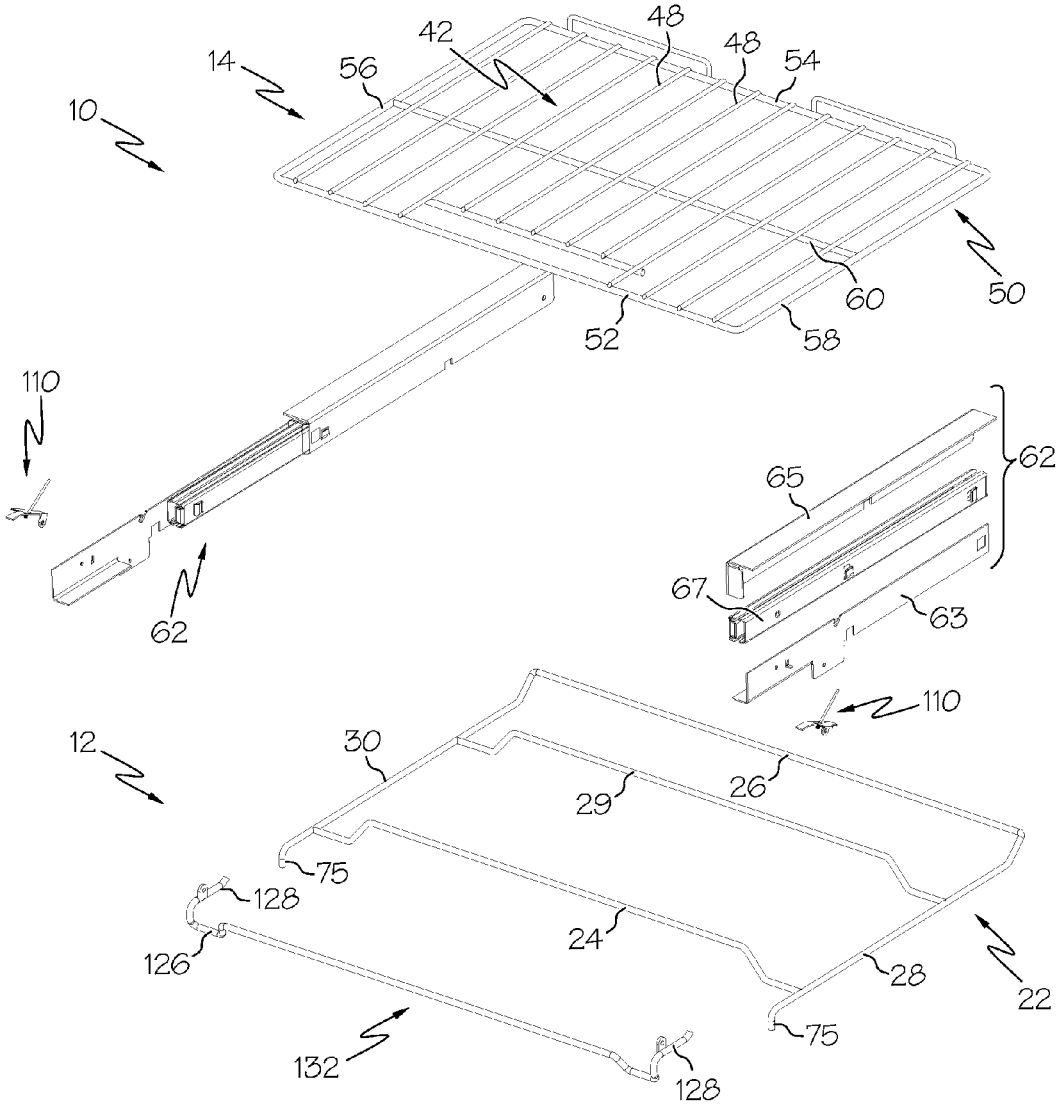
FIG. 1 illustrates an exploded, perspective view of an example of glide rack having a main section and an auxiliary section in accordance with an aspect of the present invention.

The present invention relates to a slide-out rack for an oven. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention may be practiced without these specific details.

Referring initially to FIG. 1, an example rack 10 for an appliance, such as an oven, refrigerator, or freezer is illustrated in accordance with an aspect of the present invention. For the sake of brevity, the rack 10 will be described with reference to an example oven rack, though it is to be appreciated that such example description is not intended to provide a limitation upon the present invention. The rack 10 includes a main section 12, and can also include an auxiliary section 14. As shown, the auxiliary section 14 can be relatively the same size as the main section 12, though it can also be relatively larger or smaller than the main section 12 (e.g., occupying a partial area of the rack 10). In addition or alternatively, the rack 10 can include more than one auxiliary section 14 coupled directly or indirectly to the main section 12.

Both the main section 12 and the auxiliary section 14 can be constructed from metal wire, such as iron coated with nickel or steel coated with porcelain. However, it is to be appreciated that either or both of the main section 12 and the auxiliary section 14 can be constructed from various other suitable materials (e.g., aluminum, sheet metal, or the like). Moreover, it is to be appreciated that the main section 12 can be constructed from a first material and the auxiliary section 14 can be constructed from a second different material. The auxiliary section 14 can be coupled to the main rack in various manners. For example, as shown, the auxiliary section 14 can be adapted to be slidably coupled to the main section 12, as will be discussed more fully herein.

The main section 12 can include a support frame 22 having a front bar 24, rear bar 26, and opposed side bars 28, 30 that can be attached together to form the support frame 22 in various manners, such as by welding, adhesives, or fasteners, and/or can even be formed from a single piece of wire. As shown, the support frame 22 can have a generally rectangular geometry, through it is to be appreciated that the support frame 22 can also have various other geometries. In addition or alternatively, portions of the opposed side bars 28, 30 can extend beyond the front bar 24, such that the front bar 24 can be recessed a distance back from a front portion of the auxiliary section 14. Additionally, the main section 12 can include various geometries to facilitate support of the main section 12 within an appliance. For example, as shown, the rear bar 26 of the support frame 22 can be located at a relatively higher position with respect to the front bar 24. Thus, a portion of the support members 20 attached to the rear bar 26 can act as a stop 27 to limit the extent to which an item can be inserted into an oven cavity. Additionally, the main section 12 can include at least one cross member 29 or strengthening member provided across a portion of the main section 12 to provide strength. The cross member(s) 29 operate to mitigate sagging of the main section 12 with respect to the front bar 24 when heavy food, cookware, or the like is placed on the auxiliary section 14. In one example, though not shown, the main section 12 may not include a front bar 24, but may instead include a one or more cross member(s) 29.

Figure 2A:
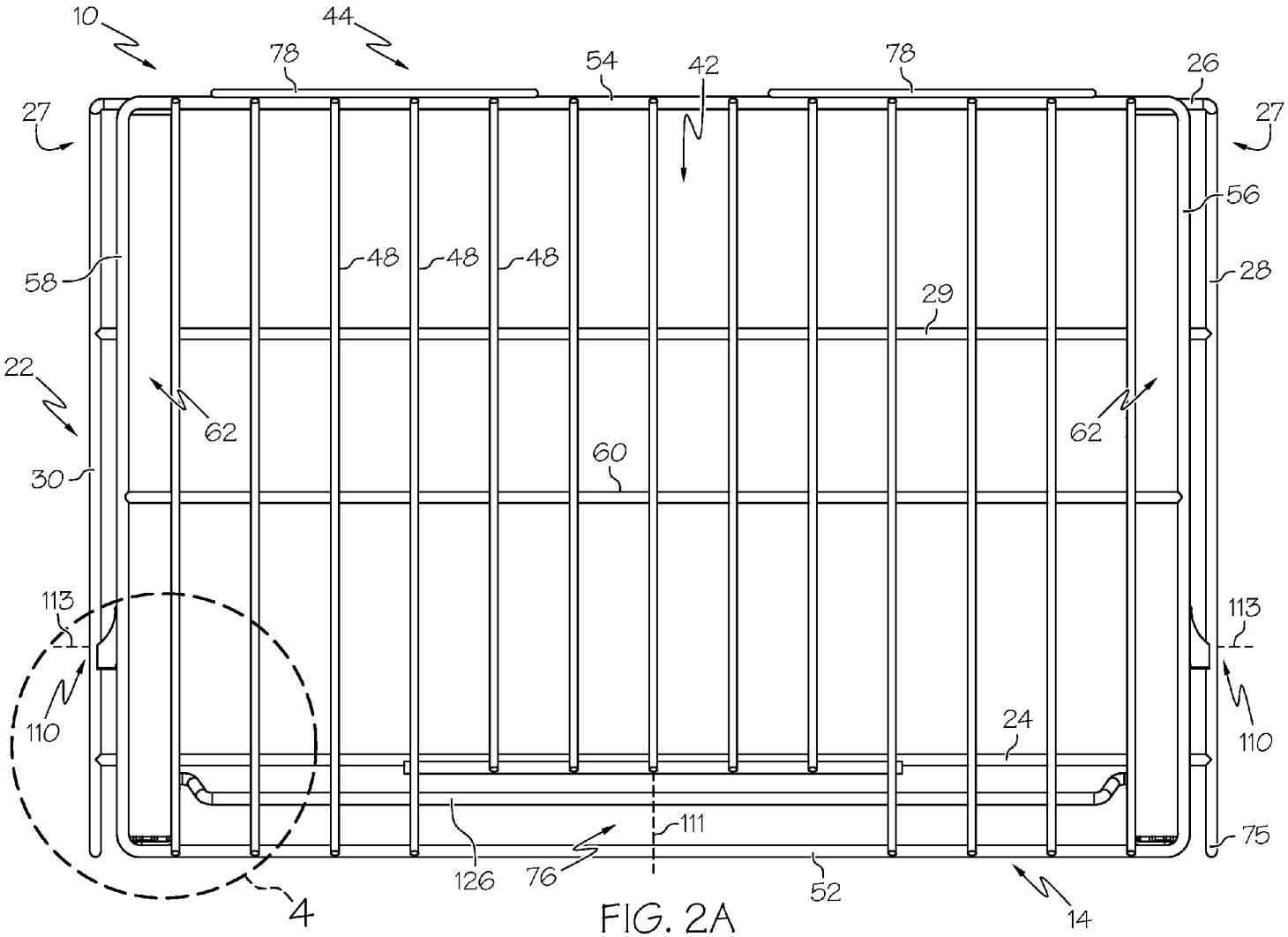
FIG. 2A is similar to FIG. 1, but illustrates a top view in which the auxiliary section is in an example retracted position.
Figure 2B:
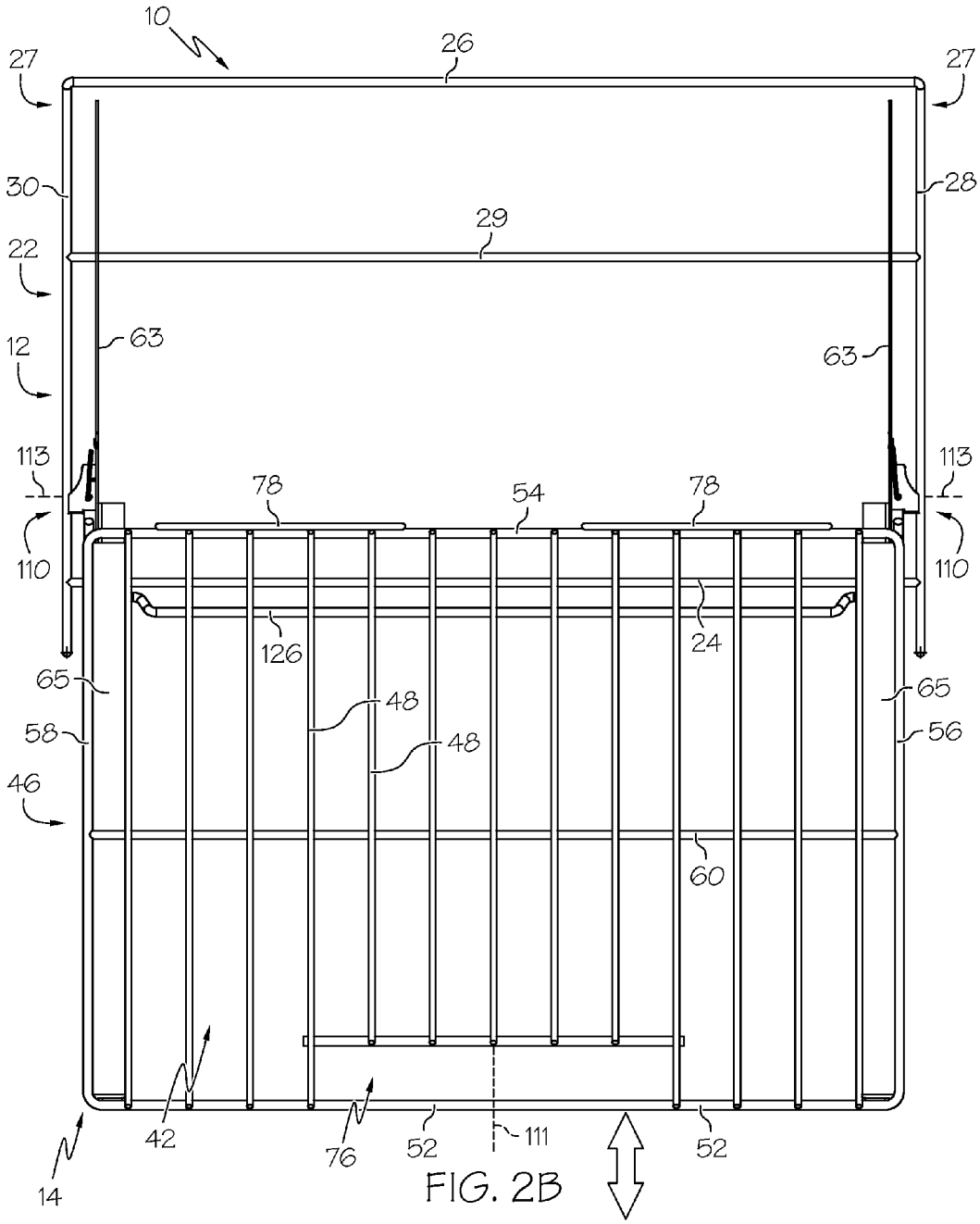
FIG. 2B is similar to FIG. 2A, but illustrates the auxiliary section in an example extended position.

As previously mentioned, the rack 10 can also include an auxiliary section 14 having an auxiliary platform area 42. The auxiliary section 14 can be adapted to be slidably coupled by the main section 12 to be moved between a retracted position 44, as shown in FIG. 2A, and an extended position 46, as shown in FIG. 2B. The auxiliary section 14 is adapted to support various items, such as cookware, food, and other items, within the oven. Further, the auxiliary section 14 can be adapted to support various items independent of whether it is in the retracted position 44 or the extended position 46. In another example, when in the extended position 46, or when in the transition between the retracted and extended positions 44, 46, the auxiliary section 14 can also be adapted to independently support various items.

The auxiliary platform area 42 can be formed by a plurality of elongated support bars 48. For example, the auxiliary platform area 42 can include a support frame 50, and the elongated support bars 48 can extend across the support frame 50. As shown, the frame 50 can include a front bar 52, rear bar 54, and opposed side bars 56, 58, and the elongated support bars 48 can extend between the front bar 52 and the rear bar 54, though it is to be appreciated that the support bars 48 can be oriented in various other manners. In addition or alternatively, the auxiliary section 14 can be configured to include various geometries, such as, for example, square, rectangular, triangular, polygonal, circular, oval and/or elliptical, and the rack 10 can even include a plurality of auxiliary sections (not shown).

Additionally, the auxiliary section 14 can include at least one cross member 60 or strengthening member provided across a portion of the auxiliary platform 42 area to provide strength. The cross member(s) 60 operate to mitigate sagging of the auxiliary platform area 42 with respect to the front bar 52 when heavy food, cookware, or the like is placed on the auxiliary platform area 42. Sagging of the auxiliary platform area 42 can present problems with easily sliding the food or cookware therefrom without interference from the front bar 52. The front bar 52, rear bar 54, and opposed side bars 56, 58 can be attached together to form the support frame 50 in various manners, such as by welding, adhesives, or fasteners, and/or can even be formed from a single piece of wire. The ends of the support bars 48 and/or the cross member 60 can be welded (e.g., spot welded), otherwise secured to, or even formed together as a single unit with, the various portions of the auxiliary section 14. Further, the support bars 48, frame 50, and/or cross member 60 can be manufactured from metal wire or any other suitable material which provides adequate strength to support items such as cake pans, pizza stones and casseroles, or the like, and withstands the heat of an oven. It is to be appreciated that the cross members 60 can be oriented in various other manners, including transverse or angled relative to the elongated support bars 48.

As stated previously, the auxiliary section 14 can be adapted to slidably move relative to the main section 12 between a retracted position 44 and an extended position 46. In addition or alternatively, the auxiliary section 14 can be adapted to telescope relative to the main section 12. Thus, as shown in FIGS. 2A and 2B, the auxiliary section 14 can be adapted to move in an overlapping fashion relative to the main section 12 generally along a first axis 111.

Figure 3:
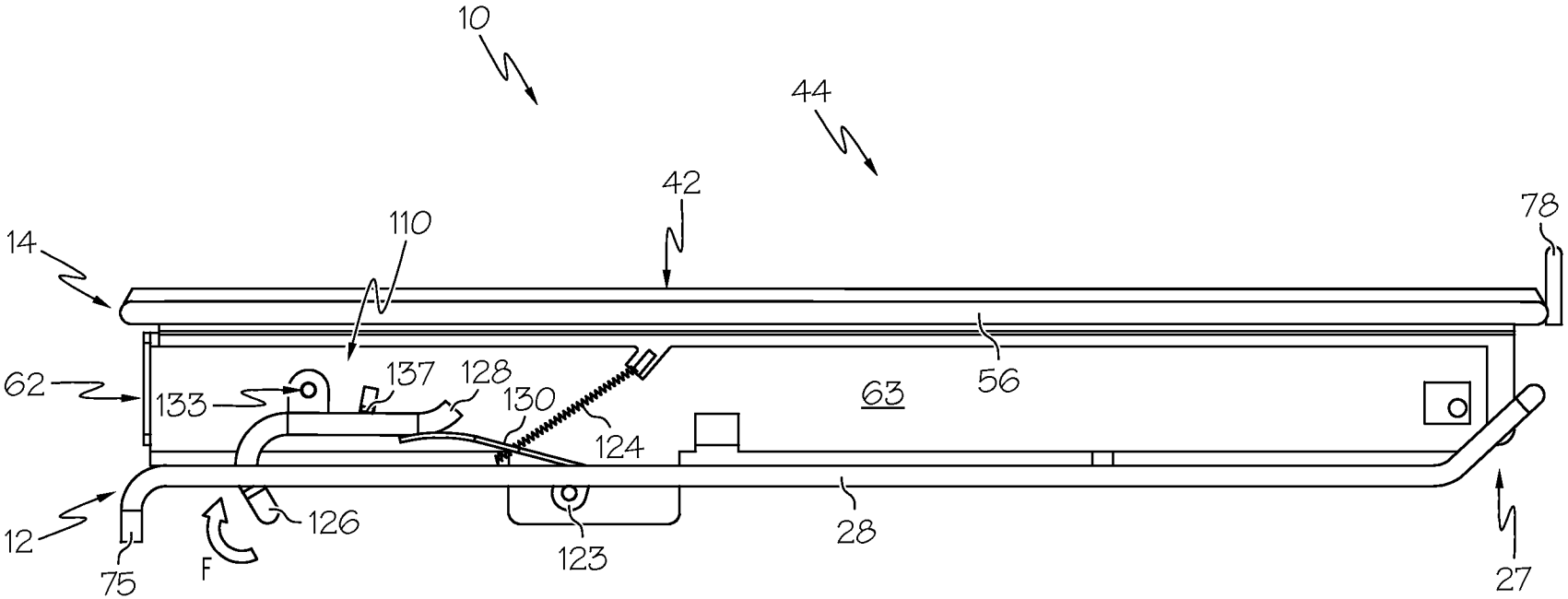
FIG. 3 is similar to FIG. 1, but illustrates a side view.

The main section 12 and/or the auxiliary section 14 can include various structures to enable the auxiliary section 14 to slidingly and/or telescopically move relative to the main section 12. In one example, the main section 12 can include a pair of telescoping slides 62 (e.g., a pair of telescoping, partial or full extension slides or glides). It is to be appreciated that the slides 62 are shown schematically in FIGS. 1-3. For example, the slides 62 can include a first portion 63 coupled to the main section 12, a second portion 65 coupled to the auxiliary section 14, and sliding structure 67 adapted to permit the first portion to move (e.g., slide, glide, telescope, move in a linear path, etc.) relative to the second portion. For example, where the main section 12 is stationary, the first portion 63 can be stationary, while the second portion 65 can move with the auxiliary section 14. It is to be appreciated that the telescoping slides 62 can also be provided with the auxiliary section 14, and/or both of the main and auxiliary sections 12, 14 can each include part of the telescoping slides 62. Further, the telescoping slides 62 can be removably and/or non-removably coupled to either or both of the main and auxiliary sections 12, 14 in various manners, such as by welding, adhesives, fasteners, jointed and/or locking connections, etc.

As is conventional, the main section 12 of the rack 10 can be adapted to move between the retracted and an extended positions relative to an appliance cavity (e.g., an oven cavity 84 or the like, see FIG. 5A), such as for insertion and removal from the appliance cavity. As previously described, the auxiliary section 14 can be further adapted to independently support various items regardless of the positioning of the main section 12. However, when the auxiliary section 14 is in the extended position 46, a large moment arm force is created and applied to the appliance through the main section 12. Thus, if the main section 12 were in an extended position at the same time that the auxiliary section 14 was in the extended position 46, (i.e., a "double extended" position, such as where the main section 12 is extended from the oven cavity 84, and the auxiliary section 14 is further extended away from the main section 12), a relatively greater moment arm force would be created and applied to the appliance through the main section 12. Such a relatively greater moment arm force could cause the main and/or auxiliary sections 12, 14 to fall out of the appliance cavity, and/or could even cause tipping of the appliance. Thus, it can be beneficial to inhibit the main section 12 from inadvertent movement, such as when the auxiliary section 14 is moved towards the extended position 46.

Correspondingly, the main section 12 can include structure to inhibit inadvertent movement of the main section 12 relative to an appliance cavity. In one example, the main section 12 can include at least one arm 110. In another example, as shown, the main section 12 can include at least two, such as a pair, of arms 110 operatively coupled to the support frame 22 and movable relative to the support frame between a first position 112 and a second position 114. The arms 110 can be positioned and configured for movement, such as pivoting movement, towards engagement with a stop portion 116 of an appliance cavity for inhibiting removal of the main section 12 from the cavity. In one example, the arms 110 can each be pivotally coupled to a respective first portion 63 of the slides 62, though can also be coupled to various other portions of the main section 12. Additionally, each arm 110 can be independently pivotable, though two or more of the arms 110 can be adapted to pivot together.

As shown in the various figures (see FIGS. 5A-5C), the rack 10 is illustrated employed within an oven environment 80. Thus, as shown, the support frame 22 of the main section 12 can be supported by guide rails 82 within an oven cavity 84. The guide rails 82 can be attached to a pair of sidewalls 86 of the oven cavity 84. As shown, the guide rails 82 of the oven environment 80 can have downward-facing projections 90. In one example, the downward facing projections 90 can act as the stop portion 116 of the cavity 84. The downward facing projections 90 can have a V-shape and can extend a distance from a sidewall 86 towards the interior of the cavity 84, though other geometries are also contemplated. In the shown example, the downward facing projections 90 are attached to (e.g., attached to or even formed with) a portion of each of the guide rails 82.

Figure 4:
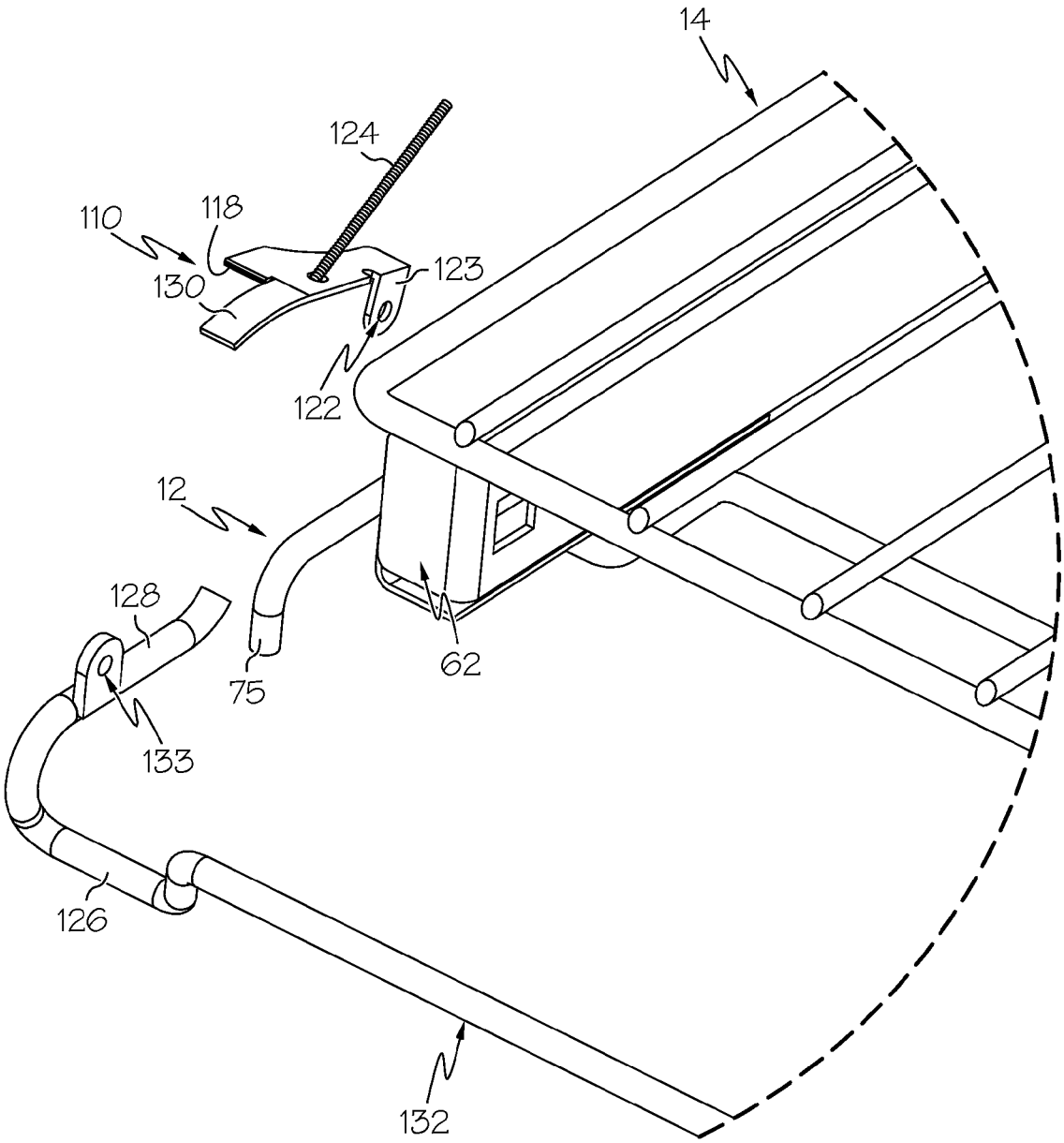
FIG. 4 illustrates an exploded, detail view of FIG. 2A of an example arm and release member in accordance with another aspect of the present invention.

Thus, in the shown example, the arms 110 are pivotally coupled to the support frame 22 and are movable relative to the support frame towards engagement with the downward facing projections 90 (i.e., the stop portions 116). Specifically, when the arms 110 are in the first position 112 (see FIG. 5A), an end 118 of each arm 110, abuts a respective downward facing projection 90 on the oven wall to inhibit or prevent the main section 12 from being removed from the cavity 84. The end 118 has a generally flat and planar profile to provide a desired positive resistance against inadvertent removal of the main section 12 from the cavity 84. As shown in FIG. 4, the end 118 is a straight edge that extends perpendicularly from one end of a concave cam surface 130, which will be described in further detail below. The position and configuration of the end 118 allows for full engagement and positive resistance to removal of the rack from the oven. In contrast, alternate bent configurations do not allow the latch to fully engage when locked and do not provide sufficient positive resistance to removal of the rack. Additionally, the end 118 can include various surface features, treatments, etc. (not shown) to increase or decrease "grip" between the end 118 and the corresponding stop portion 116. Conversely, when the arms 110 are in the second position 114 (see FIG. 5B), the end 118 of each arm 110 can move past the respective downward facing projection 90, with or without contact (e.g., sliding contact), to permit the main section 12 to be removed from the cavity 84. For example, when the arms 110 are in the second position 114, the end 118 of each arm 110 can be vertically located about, such as slightly above, at, or below, the lowest portion of downward facing projections 90 (e.g., the lowest part of stop portion 116). Therefore, movement of the arms 110 between the first and second positions 112, 114 can permit selective removal of the main section 12 from the cavity 84.

Figure 5A:
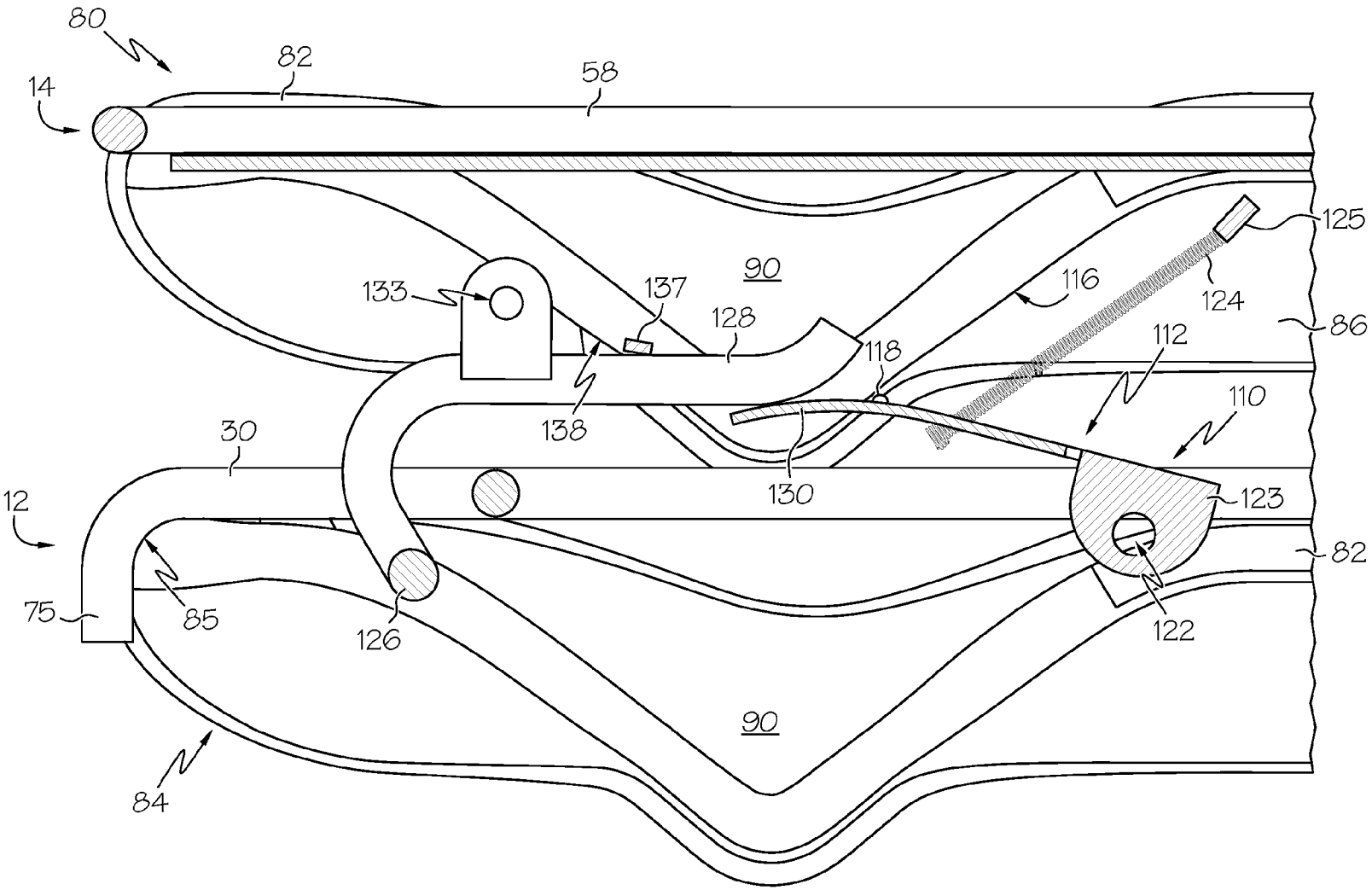
FIG. 5A illustrates a detail view of an example arm and release member with the arm in a first position.
Figure 5B:
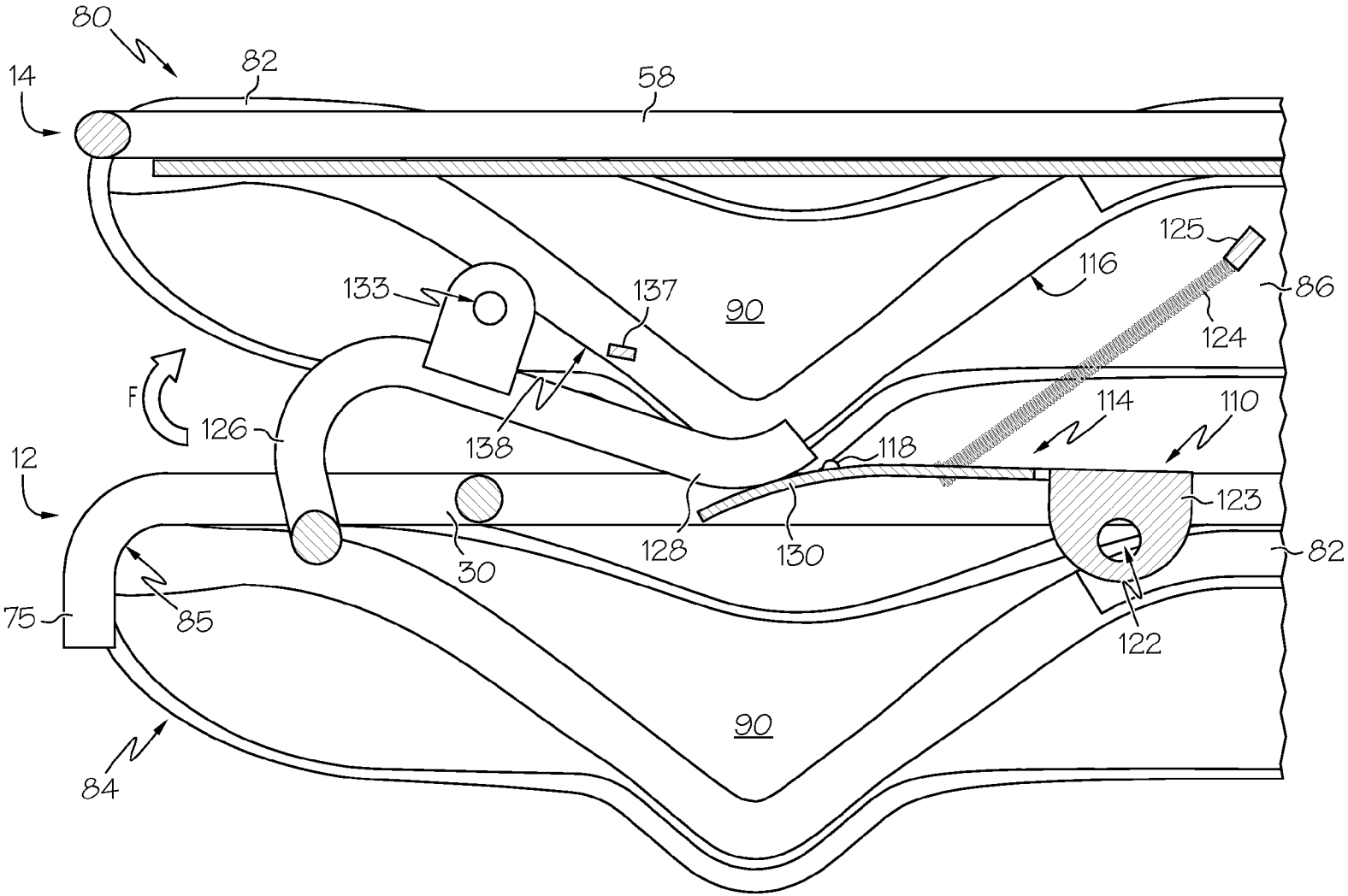
FIG. 5B is similar to FIG. 5A, but shows the arm in a second position.
Figure 5C:
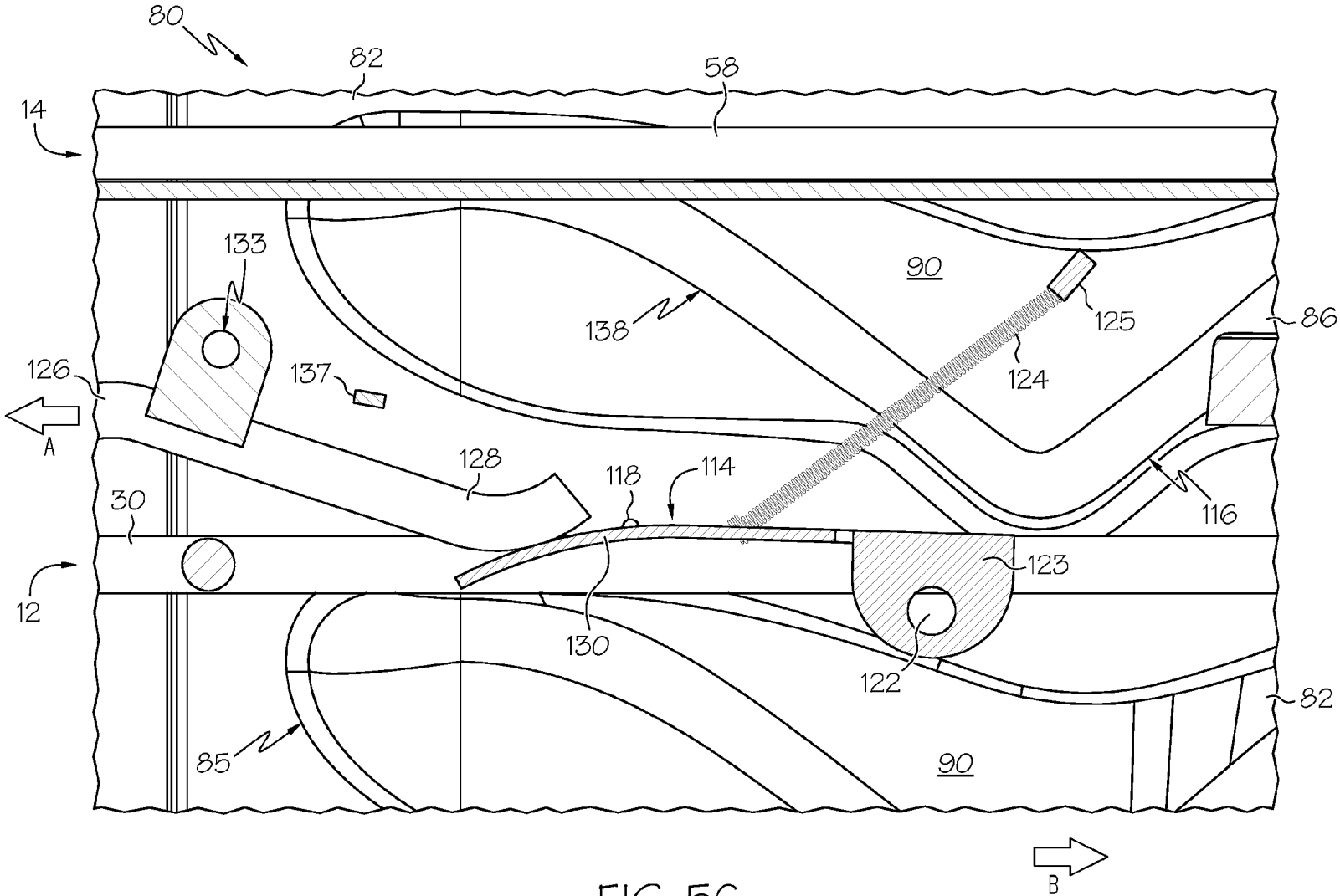
FIG. 5C is similar to FIG. 5B, but shows the glide rack partially removed from an appliance cavity.

As can be appreciated, various structure and/or methodologies can be used to control the selective movement of the arms 110 between the first and second positions 112, 114. In one example, the arms 110 can be pivotally coupled to the main section 12 for pivotal or rotational movement relative to the main section 12. The pivotal or rotational movement can be vertically up and down relative to the main section 12, such as shown in FIGS. 5A-5C, though it can also be horizontally in and out relative to the main section 12 (not shown). In addition or alternatively, though not shown, the arms 110 can also be configured for linear motion so as to move horizontally in and out, vertically up and down, and/or even in an angled or curved motion, relative to the main section 12. It is to be appreciated that various other pivotal or rotational movements are also contemplated. While the construction of one arm 110 may be discussed herein, it is to be understood that such description can apply to all arms 110. Still, one or more of the arms may include different structure from other arms.

The arms 110 can be pivotally or rotationally coupled to the main section 12 in various manners. For example, as shown, the arms 110 can be pivotally coupled to the main section 12 by way of a pin or the like (not shown) that can rotate relative to the main section 12 within a hole 122 extending partially or completely through the arms 110, and a corresponding hole (not shown) extending partially or completely through the support frame 22 (i.e., such as the first portion 63 of the slides 62). For example, the arm 110 can pivot about a second axis 113 that is generally orthogonal to the first axis 111 (e.g., the movement axis of the auxiliary section 14), though the arm 110 can also pivot about various other axes. Each arm 110 can include one or more leg portion(s) 123 adapted to be disposed adjacent a side bar 28, 30 of the support frame 22 while being coupled thereto by the pin. Alternatively, the arm 110 can be directly coupled to the support frame 22, such as by being welded to or even formed therewith. In such a case, movement of the arm 110 relative to the main section 12 would be by way of deflection of the arm 110 from a nominal position (such as the first position 112) towards a rotated or pivoted position (such as the second position 114).

Additionally, the movement of the arms 110 can be caused by various automatic and/or manual mechanisms. In one example, as shown in FIGS. 5A-5C, the arms 110 can be resiliently biased towards the first position 112 for engagement with the respective downward facing projection 90. Each arm 110 can be resiliently biased in various manners, such as by a spring 124 or the like that is directly or indirectly coupled thereto. The spring 124 could be directly coupled to the arm 110, such as between the arm 110 and the support frame 22, or alternatively could be indirectly coupled to the arm, such as by way of a release mechanism, as will be discussed more fully herein. For example, where the spring 124 is a coil spring or the like, corresponding spring connection structure can be provided, such as a projection, hook 125, or the like on each of the support frame 22 and arm 110. In addition or alternatively, where the arm 110 is directly coupled to the support frame 22, deflection of the arm 110 (such as from the nominal first position 112 towards the deflected second position 114) could be resisted by a resilient spring force of the arm 110. Despite the mechanism, it can be beneficial to bias the arm 110 towards the first position 112 so as to place the arm 110 in a position to inhibit inadvertent removal of the main section 12 from the cavity 84.

In addition or alternatively, as previously mentioned, the rack 10 can also include a release mechanism for manually moving the arms 110 from the first position 112 to the second position 114 to thereby disengage the arms 110 from the respective projections 90. It is to be appreciated that the term "disengage" is not meant to imply that the arm 110 must be physically in contact with the projection 90, though it may be, but rather that the arm 110 is moved to such a position so as to be permitted to move past the projection 90 when desired. Thus, the rack 10 can include a release member 126 operatively connected to at least one, such as both, of the arms 110. For example, actuation of the release member 126 can cause both of the arms 110 to more from the first position 112 to the second position 114, to thereby disengage each arm 110 from the respective stop portions 116 (e.g., the downward facing projections 90). Subsequently, the main section 12 of the rack 10 can be removed from the appliance cavity 84 (i.e., movement of the rack in the direction of arrow A).

The rack 10 includes a release member 126 having a first end portion and a second end portion, the first end portion being coupled to the rack 10 at a first side and the second end portion being coupled to the rack 10 at a second opposing side. The release member 126 includes a pair of link members 128 attached thereto or formed therewith. The link members 128 each extend from a portion of the release member 126 for engagement with the respective arms 110. As shown, the arms 110 each include a cam surface 130 adapted to interact with the respective link member 128. For instance, each link member 128 is adapted to abut the respective cam surface 130 so that movement of the link member 128 against the cam surface 130 causes the arm 110 to move between the first and second positions 112, 114. The geometry of the cam surface 130 is such that movement of the link member 128 against the cam surface 130 causes the arm 110 to disengage from the stop portion 116. Specifically, the cam surface 130 has a convex geometry with respect to the release member 126. The corresponding link member 128 also includes a convex geometry. This allows both the cam surface 130 and corresponding link member 128 to have relative point-to-point contact across the entire range of movement during use (see FIGS. 5A-5C), or in other words, at all points during a release actuation. Further, the end portion of the link member 128, adjacent the cam surface 130, is curved upwards to remain spaced a distance from the cam surface 130 during operation the arms 110 in both of the first and second positions 112, 114 to mitigate or prevent binding between the link member 128 and the cam surface 130. For instance, where a convex geometry is used together with a concave geometry, the relative curved geometries can "nest" with each other to create a binding situation during use. It is to be appreciated that each arm 110 can be constructed in various manners, such as from a single element or multiple elements. For example, the arm 110 can be formed from a single unitary element, such that the end 118 of the arm 110 is integrally formed together with the cam surface 130. In another example, the arm 110 can be formed from a plurality of elements coupled together by fasteners, welding, adhesives, etc.

The release member 126 can be movably coupled to the main section 12 in various manners, such as pivotally coupled by way of a pin or the like (not shown) that can rotate relative to the main section 12 within a hole 133 extending partially or completely through a leg of the release member 126, and a corresponding hole (not shown) extending partially or completely through the support frame 22 or the like (e.g., such as the slides 62). As can be appreciated, the release member 126 can have a pair of legs and holes 133 with one on each side, such as adjacent each link member 128, to permit the release member 126 to pivot across the width of the rack 10.

Further still, the release member 126 can also include other structure to facilitate actuation thereof. The release member 126 can include an input member, such as a handle 132, for receiving input from a user. For example, the handle 132 can pulled or pushed by the hand of a user, such as by a finger or palm. Thus, when a user desires to actuate the release member 126, the user can press upon the handle 132 with a force F to pivot the release member 126 (i.e., around holes 133) in such a manner that the link members 128 can move against the cam surfaces 130 to thereby disengage the arms 110 from the projections 90. In one example, a user can pull the handle 132 generally upwards towards the auxiliary section 14 to disengage the arms 110 from the projections 90. Because the release member 126 can be configured to pivot across the width of the rack 10 and be coupled to both link members 128, a user can use a single hand to disengage both the arms 110 from the projections 90 substantially simultaneously. Alternatively, the handle 132 can be configured to be moved in various other manners, such as by being pulled, rotated, pivoted, moved linearly or angularly, or various combinations thereof. The release member 126 is configured so that lower hanging portions, such as the handle 132, extend vertically downwards within a predetermined range. For instance, the handle 132 can be positioned from about one inch to about two inches below the auxiliary platform area 42, or front bar 52, and is preferably about 1.5 to 1.6 inches below the front bar 52. If the handle 132 hangs downwards too far, the handle 132 can interfere with items located on another oven rack (not shown) located below the instant rack 10. Thus, the vertical profile of the handle 132 is minimized to increase useable space below the rack 10. Further, the position of the pivot point 133 of the release member 126 can be adjusted relative to the handle 132 and/or corresponding link member 128 to thereby provide a desired balance between movement of the link member 128 (e.g., for actuating the arm 110) and movement of the handle 132 (and/or other portion of the release member 126).

Because each arm 110 can be resiliently biased to the first position by a spring 124 or the like, the release member 126 can also be resiliently biased towards a nominal position via engagement of the cam surfaces 130 with the link members 128. In addition, the main section 12 can further include a pair of limiting projections 137 each adapted to inhibit or prevent movement of a respective link member 128. The limiting projections 137 can be coupled to the support frame 22, such as to the first portion 63 of the slides 62. For example, each limiting projection 137 can be adapted to capture one of the link members 128 between the limiting projection 137 and the cam surface 130. Thus, the limiting projections 137 control movement of the release member 126 despite the resilient biasing force of the springs 124 or the like. Further, the position of the limiting projection 137 can be adjusted relative to the handle 132, corresponding link member 128, and/or pivot point 133 to thereby limit movement of the handle 132 and/or corresponding link member 128 to a desired amount.

It is to be appreciated that the engagement between the link member 128 and the cam surface 130 can be configured so as to permit each arm 110 to move in response to outside forces other than those supplied by the release members 126. For example, the appliance can include a cam portion 138 that precedes the stop portion 116 for causing an initial movement of the arm 110 during insertion of the rack 10 into the appliance cavity. In one example, as shown in FIG. 5C, the cam portion 138 can be the portion of the V-shaped downward facing projection 90 opposite the stop portion 116. Thus, during insertion of the rack 10 into the appliance cavity (i.e., movement of the rack in the direction of arrow B), the cam portion 138 can be configured to automatically move the arm 110, such as via engagement with the cam surface 130, from the first position 112 and towards the second position 114 to permit the arm 110 to pass beyond the V-shaped downward facing projection 90. After the arm 110 passes beyond the cam portion 138, the arm 110 can be moved back to the first position 112 by the spring 124 to thereby inhibit the main section 12 from being removed from the appliance cavity. For example, where the arm 110 is resiliently biased towards the first position 112, the arm 110 can automatically return to the first position 112 after it has moved beyond the cam portion 138. Thus, the main section 12 can be easily and quickly inserted into the appliance cavity without the user having to manually move the arm 110 beyond the downward facing projection 90, and likewise the main section 12 can automatically "lock" itself into position to inhibit inadvertent removal without requiring additional user input.

The rack 10 can also include various other features. In one example, various elements can include coatings or other treatments to inhibit or prevent damage to other elements. It is to be appreciated that the various additional features discussed herein are not intended to provide any limitation upon the present invention, and that modification of the features and or the addition of other features are contemplated to be within the scope of the invention. For example, any or all of the end 118 of the arms 110, the downward-facing projections 90, the link members 128 and/or the cam surfaces 130 can include a coating or treatment to inhibit damage thereto. Various coatings or treatments can be used, such as ceramic and/or polymer coatings, hardening treatments, surface treatments, etc.

In another example, in place of an outward extending projection, the stop portion 116 could be replaced by an aperture (not shown) or the like. The aperture could include a detent, or even a hole, extending partially or completely through the sidewall 86 of the appliance cavity. For example, instead of abutting a projection 90 to inhibit removal of the main section 12, the end 118 of each arm 110 could be received within the aperture. Thus, interaction of the end 118 with the aperture could inhibit the main section 12 from being removed, and subsequent extraction of the end 118 from the aperture could permit the main section 12 to be removed from the cavity.

In another example, the auxiliary section 14 can include a handle portion 76 adapted to facilitate movement of the auxiliary platform from the retracted position 44 to the extended position 46. As shown, the handle 76 can be formed of a similar material as the main section 12 (e.g., metal wire or the like) and can be attached to (e.g., welding or the like), or formed with, the front bar 52 of the auxiliary section 14. In addition or alternatively, the handle 76 can also be disposed at various other locations, and can even be formed as part of the front bar 52. The handle 76 can be configured to be grasped to a hand of a user, and can include various coatings and/or a covering member (e.g., silicone, porcelain, ceramic, or the like) adapted to insulate a user's hand from the heat of an oven. In addition or alternatively, the main section 12 can also include a handle (not shown) to facilitate movement of the rack 10 relative to the oven cavity 84.

Further still, the auxiliary section 14 can include a rear stop 78 for limiting the placement of items upon the auxiliary platform area 42. For example, as shown, a pair of rear stops 78 can be removably or non-removably attached for the rear bar 54, such as by welding, adhesives, fasteners, etc. The rear stop(s) 78 can limit the extent to which items can be placed within the appliance cavity, and can also facilitate removal of items from the appliance cavity. For example, when the auxiliary section 14 is moved to the extended position 46, the rear stops 78 can inhibit relative movement (e.g., such as might be caused by inertia) between an item supported on the auxiliary section 14, and the auxiliary section 14 itself. As the auxiliary section 14 is drawn out of the appliance cavity, the rear stop(s) 78 can abut a supported item to inhibit slipping to draw the item out along with the auxiliary section 14.

Even further still, the auxiliary section 14 can be adapted to be removable from the main section 12. For example, the auxiliary section 14 can be completely removed from the main section 12 such that the main section can remain within an oven while the auxiliary section 14 is removed therefrom. For example, when the auxiliary section 14 is removed from the main section 12, it can be stored or used as a cooling rack for supporting hot items or baked goods on a counter top. In one example, the auxiliary section 14 can be removed from the main section 12 by orienting it at an angle relative to the main section 12 to release the glides/slides 62 to thereby disengage the auxiliary section 14 from the main section 12, though other methods of removal are also contemplated. It is to be appreciated that the glides/slides 62 may be removable with the auxiliary section 14, or may remain coupled to the main section 12.

In addition or alternatively, portions of the opposed side bars 28, 30 can extend beyond the front bar 24, such that the front bar 24 can be recessed a distance back from a front portion of the auxiliary section 14. In one example, a front portion 75 of the either or both of the opposed side bars 28, 30 can form a stop for the rack 10 within the oven environment 80. For example, either or both of the front portions 75 can have a downwardly extending geometry that is adapted to form a stop for engagement with a guide rail 82, thereby facilitating quick and easy placement of the rack 10 within the oven cavity 84. In other examples, the front portions 75 can include other stop structure, such as two ball-shaped projections (or other geometry, not shown) that are welded or otherwise secured to a bottom portion of the opposed side bars 28, 30. Thus, a user is able to slide the rack 10 onto the a guide rail 82 such that the opposed side bars 28, 30 of the rack 10 slide along a top portion of the guide rail 82 until the front portions 75 contact an end portion 85 of the guide rail 82, thereby properly and securely positioning the rack 10 along the guide rail 82. Still, the front portions 75 acting as a stop can be coupled to the front bar 24 or other structure of the rack 10.

Accordingly, with the rack 10 supported within the oven cavity 84, the auxiliary platform area 42 of the auxiliary section 14 can be utilized to support various items for cooking within the oven. As shown in FIGS. 2A-2B, the auxiliary section 14 can be supported with in the oven cavity 84 in either of the retracted and/or the extended positions 44, 46. Thus, for example, various items could be easily retrieved from the auxiliary section 14 without also having to extend the main section 12. It is to be appreciated that the arms 110 are configured, as described variously above, to inhibit, such as prevent, the main section 12 from also extending from the cavity while the auxiliary section 14 is in the fully extended position 46. In addition or alternatively, various items can also be supported on other oven racks (not shown) simultaneously without the need to add or remove any other racks.

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the example embodiments, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A rack for an appliance, including:

a main section having a support frame, the support frame having a front bar, a rear bar, a first side bar, and a second side bar;

at least one arm coupled to the support frame and having an end configured to abut a respective downward facing projection on a wall of an appliance, the arm being movable relative to the support frame between a first position and a second position; and a release member operatively connected to the at least one arm, actuation of the release member causing the at least one arm to move from the first position to the second position, wherein the release member includes a first end portion and a second end portion, the first end portion being coupled to the first side bar and the second end portion being coupled to the second side bar, and wherein the end of the at least one arm is an edge, wherein the rack includes a pair of arms each movable relative to the support frame between a first position and a second position and each arm including a cam surface and wherein the release member includes a pair of link members, actuation of the release member engaging the link members within the respective cam surfaces causing the arms to move from the first position to the second position, and wherein the main section further includes a pair of slides which includes a pair of limiting projections each adapted to capture one of the link members between the limiting projection and the cam surface.

2. The, rack of claim 1, wherein the at least one arm is resiliently biased towards the first position.

3. The rack of claim 1, wherein the at least one arm is configured for pivoting movement towards the first position for engagement with a stop portion of an appliance cavity for inhibiting removal of the main section therefrom.

4. The rack of claim 1, wherein the release member includes a handle potion operatively coupled to both of the link members.

5. The rack of claim 1, wherein the cam surface is convex.

6. The rack of claim 5, wherein the each of the link members includes convex end portions configured to contact the corresponding convex cam surface of the arms.

7. The rack of claim 1, wherein the release member is pivotally coupled to the main section.

8. The rack of claim 1, wherein the rack further includes an auxiliary section having an auxiliary platform area, the auxiliary section being adapted to be slidably coupled to the main section to move between a retracted position and an extended position.

9. A rack for an appliance, including:

a main section having a support frame adapted to be supported by guide rails on sidewalls within an appliance;

a pair of arms coupled to the support frame and each movable relative to the support frame, each arm being configured to abut corresponding stop portions on the guide rail of said sidewalls for inhibiting removal of the main section from an appliance cavity; and a release member operatively connected to both of the arms, actuation of the release member causing both of the arms to disengage from respective stop portions of said guide rails, wherein the arms each include convex cam surfaces, and wherein the release member includes a pair of link members having convex-shaped end portions configured to engage the convex cam surfaces, wherein the stop portions each include a downward extending projection formed with a portion of one of the guided rails of said appliance, and wherein the convex cam surfaces of each arm are configured to automatically move each arm away from a first position and toward second position, whereupon passage of the arms beyond a cam portion of each guide rail permits the arms to be resiliently biased back toward the first portion.

10. The rack of claim 9, wherein each arm is pivotally coupled to the support frame for movement between a first position and a second position, both of the arms being resiliently biased towards the first position for engagement with respective projections, and wherein each arm includes an end having an edge that contacts the respective projections.

11. The rack of claim 10, wherein the edge of each end of each arm is substantially perpendicular to the corresponding stop portion of said guide rails.

12. The rack of claim 9, wherein the rack further includes an auxiliary section having an auxiliary platform area, the auxiliary section being adapted to be slidably coupled to the main section to move between a retracted position and an extended position.

13. The rack of claim 9, wherein the convex cam surfaces engage the convex link members in point-to-point contact across an entire range of movement.

14. The rack of claim 9, wherein the arms are resiliently biased away from the main section and towards engagement with the stop portions.

15. An rack for an appliance, including:

a main section having a support frame adapted to be supported by guide rails on sidewalls within an appliance;

an auxiliary section having an auxiliary platform area, the auxiliary section being adapted to be slidably coupled to the main section to move between a retracted position and an extended position;

a pair of arms coupled to the support frame and each movable relative to the support frame, each arm being resiliently biased away from the main section and configured to abut corresponding stop portions on the guide rails of said sidewalls for inhibiting removal of the main section from an appliance cavity; and a single release member pivotally coupled to the main section and operatively coupled to both of the arms, actuation of the single release member causing both of the arms disengage from respective stop portions, wherein each arm includes a convex cam surface, wherein the single release member includes a pair of link members having convex end portions, movement of the single release member engaging the link members with the convey cam surfaces causing the arms to disengage from the stop portion on the guide rails of said appliance, and wherein the main section further includes a pair of slides which include a pair of limiting projections each adapted to capture one of the link members between the limiting projection and the convex cam surface.

* * * * *